US005987277A

United States Patent [19]

Okabe

[11] Patent Number: 5,987,277

[45] Date of Patent: Nov. 16, 1999

[54] SYSTEM FOR TRANSFERRING TONER TO AND FROM A PHOTOSENSITIVE DRUM IN A PRINTING PROCESS UNIT

[75] Inventor: Yasushi Okabe, Nagoya, Japan

[73] Assignee: Brother Kogyo Kabushiki Kaisha, Nagoya, Japan

[21] Appl. No.: 08/867,811

[22] Filed: Jun. 3, 1997

[30] Foreign Application Priority Data

Jun. 6, 1996 [JP] Japan ..... 8-144139

[51] Int. Cl.[6] ..... G03G 15/08; G03G 21/00

[52] U.S. Cl. ..... 399/103; 399/105; 399/149

[58] Field of Search ..... 399/103, 105, 399/149, 150, 106

[56] References Cited

U.S. PATENT DOCUMENTS 3,809,012 5/1974 Delvecchio ..... 399/105
3,914,045 10/1975 Namiki et al. ..... 399/149
5,333,041 7/1994 Ito et al. ..... 399/149
5,625,440 4/1997 Matsumae et al. ..... 399/103 X
5,717,973 2/1998 Endoh et al. ..... 399/105 X
5,740,494 4/1998 Shoji et al. ..... 399/149 X

*Primary Examiner*—Fred L. Braun
*Attorney, Agent, or Firm*—Oliff & Berridge, PLC

[57] ABSTRACT

A space between side seals at both sides of a supplying roller becomes gradually wide by inclining the leading edges of the side seals for making a width W1 at a position immediately before the side seals are in contact with a developing roller larger than a printable width W2 (the minimum width between the side seals). Further, a width W3 of a cleaning roller is set to be larger than the width W2 and smaller than the width W1. By this construction, residual toner is entirely removed by the cleaning roller at the printing operation, and all of the collected toner is caused to be concentrated within the width W2 by the side seals during the non-printing operation

13 Claims, 6 Drawing Sheets

PRIOR ART

SYSTEM FOR TRANSFERRING TONER TO AND FROM A PHOTOSENSITIVE DRUM IN A PRINTING PROCESS UNIT

BACKGROUND OF THE INVENTION

1. Field of the invention

The present invention relates to a printing process unit for performing a printing operation by adhering toner to a printing medium by a photosensitive drum, and more particularly, to a printing process unit which is capable of collecting all toner remaining on the photosensitive drum after the printing operation to eliminate stains of the printing medium.

2. Description of the Related Art

A printing process unit of a printer such as a laser printer in which toner is adhered to a printing medium to perform printing operation, for example, is provided with a developing roller 92 and a cleaning roller 93 each at the front side and rear side of a photosensitive drum 91 for adhering toner to a printing medium S as shown in a sectional view of FIG. 6. The developing roller 92 serves to supply toner to the photosensitive drum 91 and the cleaning roller 93 serves to collect residual toner on the photosensitive drum 91. Provided above the photosensitive drum 91 is a transferring roller 94 which absorbs toner on the photosensitive drum 91 toward the printing medium S.

When the printing operation is performed in this printing process unit, the printing medium S passes through between the photosensitive drum 91 and the transferring roller 94, while a printing image is exposed by a laser beam at a point of P on the photosensitive drum 91. The exposed portion has a lower potential compared to the other portions, whereby an electrostatic latent image is formed. Further, the transferring roller 94 and the cleaning roller 93 are caused to keep a potential lower than that of the exposed image of the photosensitive drum 91. As a result, positive toner is supplied from the developing roller 92 at the position where the photosensitive drum 91 opposes to the developing roller 92, resulting in that the positive toner is adhered to the exposed image of the photosensitive drum 91 to form the electrostatic latent image.

When this portion reaches the position where the transferring roller 94 opposes to the printing medium S, toner on the photosensitive drum 91 is absorbed by the transferring roller 94 due to its low potential to adhere onto the printing medium S. Accordingly, the toner image is transferred to the printing medium S, and then, a fixing procedure is executed to the printing medium S to complete the printing operation. On the other hand, toner is somewhat remained on the photosensitive drum 91, however, this residual toner is collected by the cleaning roller 93 due to its low potential at the position where the photosensitive drum 91 opposes to the cleaning roller 93 for preventing the printing medium S from being stained when the medium S opposes again to the photosensitive drum 91.

When the printing operation is not performed, the potential of the cleaning roller 93 is kept higher than that of the photosensitive drum 91, and the potential of the transferring roller 94 is kept lower than that of the photosensitive drum 91. As a result, toner accumulated onto the cleaning roller 93 is removed to the photosensitive drum 91 to be collected by the transferring roller 94 due to its low potential at the position where the photosensitive drum 91 opposes to the transferring roller 94. This is because the toner accumulated onto the cleaning roller 93 is removed to be reused.

Considering the time when the printing process unit described above is performing the printing operation, the cleaning roller 93 has to collect all of the residual toner on the photosensitive drum 91. From this point of view, it is necessary that the whole width "b" of the cleaning roller 93 is the same as or more than the maximum width "a" which is set for supplying toner to the photosensitive drum 91 from the developing roller 92. When the width "b" is smaller than the width a, the residual toner may not be collected by the cleaning roller 93 to arrive again at the position where the photosensitive drum 91 opposes to the printing medium S, thereby being likely to stain the printing medium S. It is to be noted that the width "a" is smaller than the whole width of the developing roller 92 in FIG. 7, which is because toner is supplied to the developing roller 92 in the area of the width "a" from a toner supplying roller which is separately provided, and then the developing roller 92 supplies toner to the photosensitive drum 91.

On the other hand, considering the collecting of the residual toner on the cleaning roller 93 at the time when the printing process unit is not performing the printing operation, the developing roller 92 has to collect all toner removed to the photosensitive drum 91 from the cleaning roller 93. From this viewpoint, whole width "b" of the cleaning roller 93 has to be the same as or smaller than the developing width "a" of the developing roller 92 as shown in FIG. 8. When the width "b" is greater than the width "a", toner may be adhered to the outside of the width "a" of the developing roller 92, whereby it is likely to stain the portion other than the printing width of the printing medium S upon successive printing operation.

Both of the factors described above are contrary requirements. Further, it is impossible to strictly accord the width "a" with the width "b" in a real mass production process in which an allowance cannot be ignored, whereby it has been likely to occur that all toner are not collected due to this allowance to stain the printing medium S. There may be the case where one of the factors at the printing operation and non-printing operation is sacrificed to render the difference between the width "a" and the width "b" somewhat greater for assuredly preventing the stain caused by the other factor. However, the size (particularly width) of the printing process unit becomes unnecessarily large.

SUMMARY OF THE INVENTION

The present invention is accomplished to solve the above-mentioned problem of the conventional printing process unit, and aims to provide a printing process unit capable of assuredly collecting residual toner on the photosensitive drum by the cleaning roller upon printing operation and capable of causing toner not to be adhered to the portion other than the developing width of the developing roller upon non-printing operation, thereby preventing the deterioration due to unnecessary toner and rendering the unit small-sized.

In order to accomplish the above-mentioned object, the invention described in a first aspect is a printing process unit utilized for a printer, comprising a photosensitive drum for transferring toner to a print medium, a developing roller for supplying and collecting toner at a position before transferring operation by the photosensitive drum to the print medium, a cleaning roller for collecting and removing toner at a position after the transferring operation by the photosensitive drum to the print medium, the cleaning roller having a width which is larger than a width capable of printing on the print medium, and a pair of side seal members for gathering toner removed to the photosensitive drum from the cleaning roller and collected on the developing roller within a width smaller than the width of cleaning roller.

In another aspect of the present invention, a printing process unit utilized for a printer comprises a photosensitive drum for transferring toner to a print medium, a developing roller for supplying and collecting toner at a position before transferring operation by the photosensitive drum to the print medium, a cleaning roller for collecting and removing toner at a position after the transferring operation by the photosensitive drum to the print medium, the cleaning roller having a width which is larger than a width capable of printing on the print medium, and a pair of side seal members for gathering toner removed to the photosensitive drum from the cleaning roller and collected on the developing roller, the side seal members cooperatively gathering toner from a range wider than the width of cleaning roller toward a range smaller than the width of cleaning roller.

In this printing process unit, the printing operation is performed as follows while rotating the photosensitive drum and transporting the printing medium. Firstly, toner is supplied to the photosensitive drum from the developing roller to form a toner image. The supply of the toner is executed at the position before the photosensitive drum transfers toner onto the printing medium, so that the formed image reaches the transferring position to the printing medium due to the rotation of the photosensitive drum to be transferred to the printing medium to perform printing operation. During the transferring, some toner may remain on the photosensitive drum. This residual toner reaches the position where the photosensitive drum opposes the cleaning roller due to the rotation of the photosensitive drum to be collected. The width of the cleaning roller is larger than the width which is capable of printing to the printing medium, i.e., larger than the maximum width capable of supplying toner from the developing roller, whereby the residual toner is entirely collected by the cleaning roller. Accordingly, it does not occur that a part of the residual toner reaches again the transferring position to the printing medium due to the rotation of the photosensitive drum to stain the printing medium.

At the time of non-printing operation, the following operation is performed while not transporting the printing medium but rotating the photosensitive drum. Firstly, toner accumulated on the cleaning roller is removed to the photosensitive drum. The toner removed and adhered to the photosensitive drum reaches the position where the photosensitive drum opposes to the developing roller due to the rotation of the photosensitive drum to be collected. By this, the cleaning roller is cleaned and toner is reused. The toner collected by the developing roller may be distributed all over the width of the cleaning roller, i.e., distributed beyond the width which is capable of printing to the printing medium. However, the toner collected by the developing roller is gathered by the side seal members to be stored within a width smaller than the width of the cleaning roller. Therefore, the printing medium or the like is prevented from being stained by unnecessary toner which is supplied to the photosensitive drum at the portion other than the range between the side seal members during the successive printing operation.

PREFERRED EMBODIMENT OF THE INVENTION

The embodiment according to the present invention will be explained in detail with reference to the drawings. The embodiment shows that the printing process unit of the present invention is embodied-as a laser printer.

Figure 1:
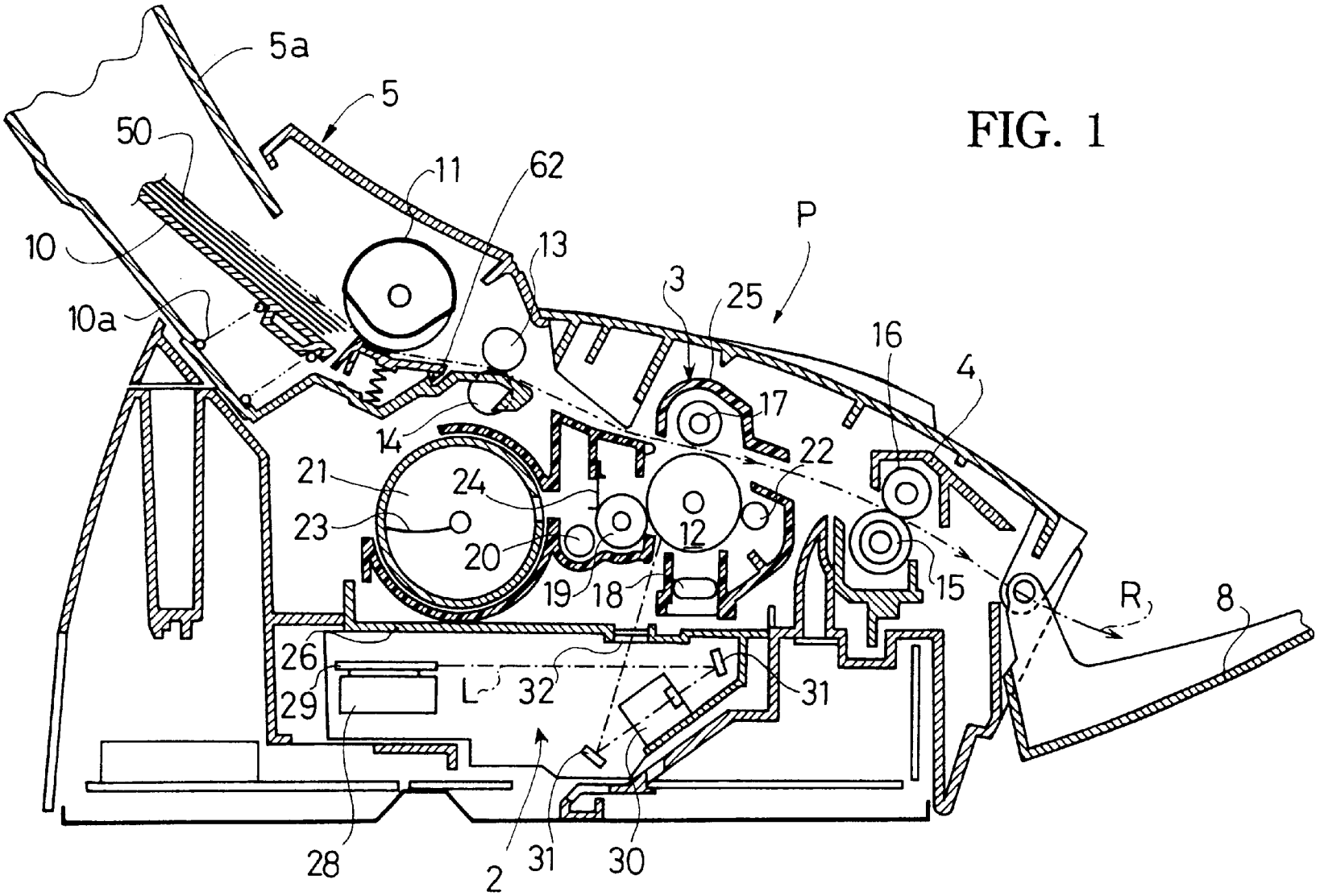
FIG. 1 is a sectional view of a laser printer according to the embodiment.

A schematic construction of the inside of a laser printer P according to the embodiment is explained based upon FIG. 1. The laser printer P shown in FIG. 1 is schematically constructed by a feeding unit 5 at the upper left portion in the figure, a process unit 3 at the central portion, a scanner unit 2 below the process unit 3 and a fixing unit 4 at the right side of the process unit 3. The feeding unit 5 is for feeding overlaid paper 50 accommodated in the feeding unit 5 one by one to the process unit 3. The process unit 3 which is provided with a photosensitive drum 12 is for forming a toner image on the photosensitive drum to be transferred onto the paper 50. The scanner unit 2 which has a known laser optical system is for forming an electrostatic latent image on the photosensitive drum 12 by a scanning operation of the laser optical system based upon a predetermined image data. The fixing unit 4 is for fixing the toner image transferred onto the paper 50 by the process unit 3.

At first, the feeding unit 5 is explained. Provided inside of a feeder case 5*a* of the feeding unit 5 are a support plate 10 for placing the overlaid paper 50 thereon and a feeding roller 11 for transporting the paper 50 one by one. The support plate 10 is pressed toward the feeding roller 11 by an urging spring 10*a*. A paper separating member 62 for separating the overlaid paper 50 one by one is provided below the feeding roller 11. A pair of resist rollers 13 and 14 for directing the separated paper 50 to the process unit 3 are mounted downstream of the paper separating member 62.

Subsequently, the process unit 3 is explained. The process unit 3 is constructed by a transferring roller 17 positioned above the photosensitive drum 12, a scorotron type charger 18 below the photosensitive drum 12, a developing roller 19 and a supplying roller 20 disposed upstream of the photosensitive drum 12 with respect to the feeding direction, a toner cartridge 21 serving as a toner supplying section and removably provided upstream of the rollers 19 and 20 and a cleaning roller 22 disposed downstream of the photosensitive drum 12 with respect to the feeding direction.

The charger 18 is for forming a charged layer at the outer peripheral surface of the photosensitive drum 12. The outer peripheral surface of the photosensitive drum 12 on which the charged layer is formed is subject to a scanning of a laser beam L from the laser scanner unit 2 immediately after the charged layer is formed. The charged layer at the portion to which the laser beam L is irradiated is destroyed, so that the surface potential at this portion becomes lower than that of the non-irradiated portion by several hundreds volts, thereby forming an electrostatic latent image.

The developing roller 19 carries on its outer peripheral surface the toner supplied from the toner cartridge 21 via the supplying roller 20 and offers the toner to the electrostatic latent image on the photosensitive drum 12 for making a visual image, i.e., for developing. In view of this, the developing roller 19 keeps a potential higher than that of the electrostatic latent image on the photosensitive drum 12. Further, the developing roller 19 can possess a potential lower than that of the photosensitive drum 12 by switching over the potential in order to collect the toner accumulated on the cleaning roller 22 as described later. The developing roller 19 is provided with a blade 24 for regulating the thickness of the carried toner layer. The toner in the toner cartridge 21 is agitated by an agitator 23 and supplied to be carried on the outer peripheral surface of the developing roller 19 by the supplying roller 20.

The transferring roller 17 applies an electric field to the toner image on the photosensitive drum 12 to absorb the toner image toward the paper 50 for transferring, while the paper 50 is passing between the photosensitive drum 12 and the transferring roller 17. The cleaning roller 22 collects by the electric field the residual toner on the photosensitive drum 12 after the toner image is transferred to the paper 50. In view of this, the transferring roller 17 and the cleaning roller 22 keep the potential lower than that of the electrostatic latent image on the photosensitive drum 12. Further, the cleaning roller 22 can possess a potential higher than that of the photosensitive drum 12 by switching over the potential in order to remove the accumulated toner as a result of collecting to the photosensitive drum 12.

The process unit 3 constructed as described above is incorporated into a case 25 made of synthetic resin to form as a cartridge. This cartridge type process unit 3 is removably inserted to the laser printer P.

Subsequently, the scanner unit 2 is explained. The scanner unit 2 has in a scanner cover 26, a laser emitting section 28, polygon mirror 29, lens 30, reflecting mirror 31 and the like. When the laser emitting section 28 emits the laser beam L based upon the image data, the laser beam L is scanned by the rotation of the polygon mirror 29 to be irradiated by the lens 30 and the reflecting mirror 31 to the photosensitive drum 12 through a window 32 of the scanner cover 26.

Next, the fixing unit 4 is explained. The fixing unit 4 provided with a pair of heat roller 15 and a pressing roller 16. With the paper 50 passing between the heat roller 15 and the pressing roller 16, the fixing unit 4 fixes the toner image transferred to the paper 50 by the process unit 3 and discharges the paper 50 onto a discharging tray 8 at the right end of the laser printer P to be stacked. It is to be noted that the path R of the paper 50 from the feeding unit 5 to the discharging tray 8 is shown in FIG. 1 by two-dot chain line.

Figure 2:
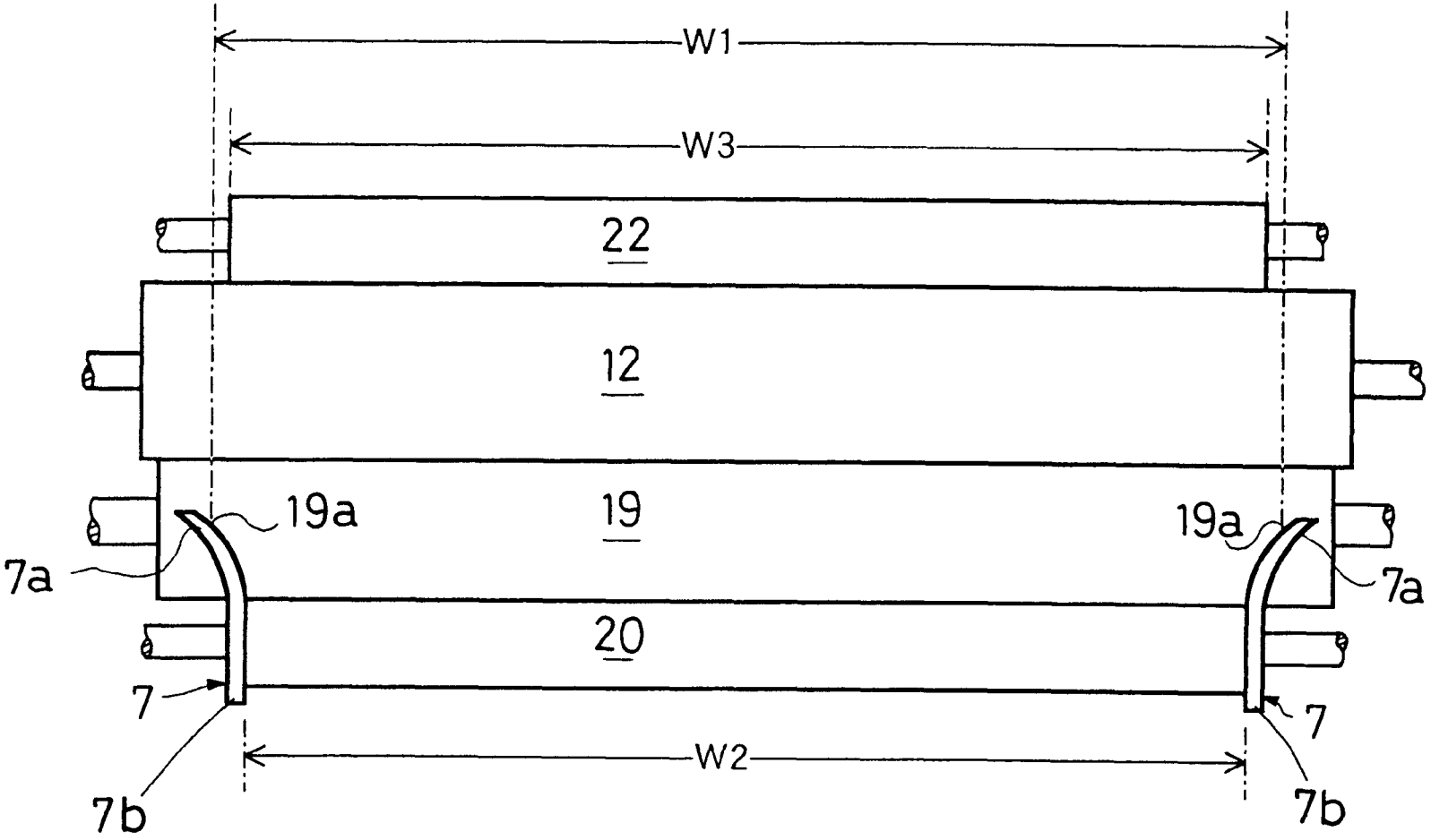
FIG. 2 is a view in which essential parts of the process unit are seen from below.

The process unit 3 is further explained in detail. When the photosensitive drum 12, developing roller 19, supplying roller 20 and the cleaning roller 22 of the process unit 3 are seen from below, side seals 7, 7 are provided at both sides of the supplying roller 20 through bases 7*b*, 7*b* as shown in FIG. 2. The leading edges 7*a*, 7*a* of the side seals 7, 7 are inclined to widen the space between the side seals and reach approximately the center portion of the developing roller 19.

Figure 3:
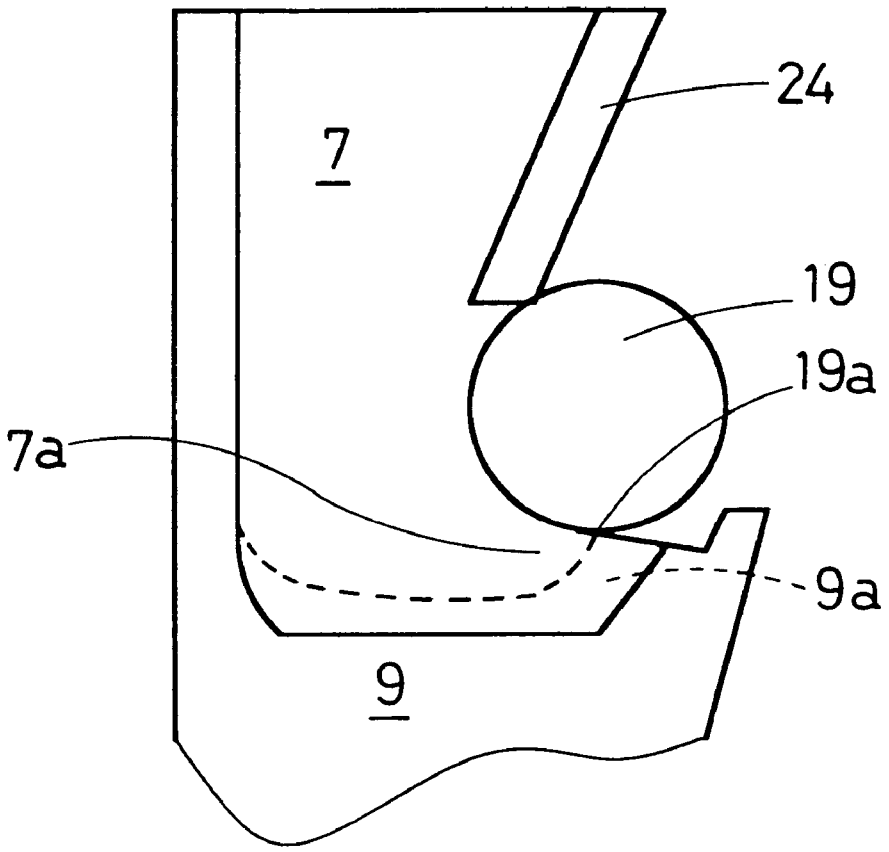
FIG. 3 is a side view of a side seal and its peripheral portion.
Figure 4:
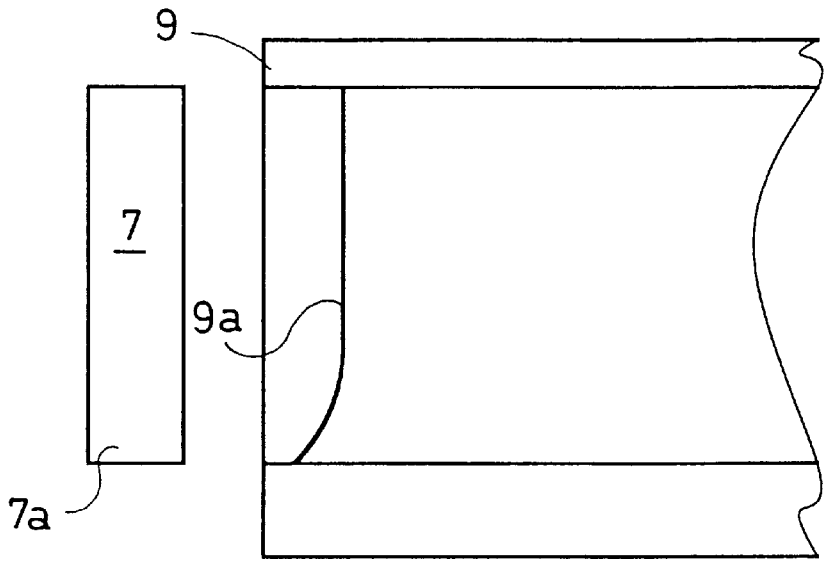
FIG. 4 is a plan view of a side seal holder and the side seal.
Figure 5:
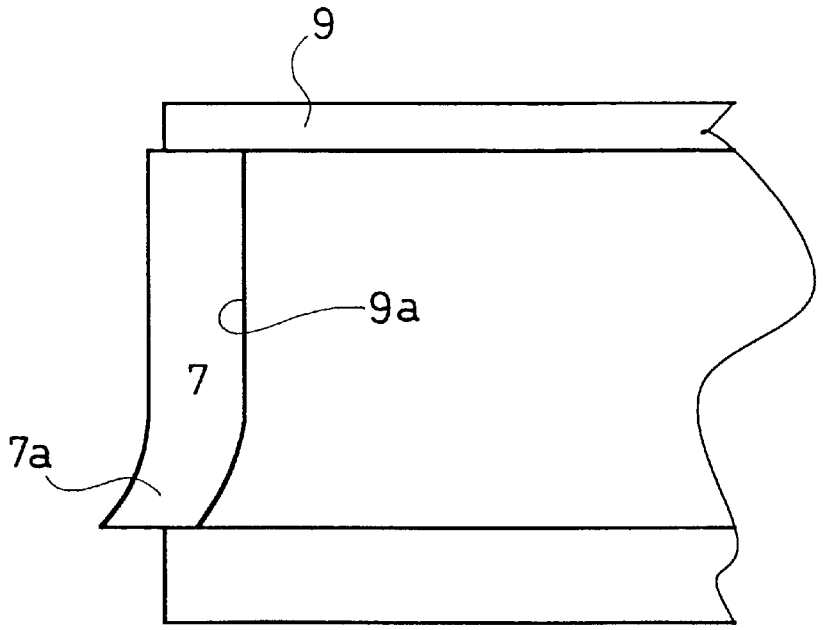
FIG. 5 is a view showing an inserting state of the member shown in FIG. 4.
Figure 6:
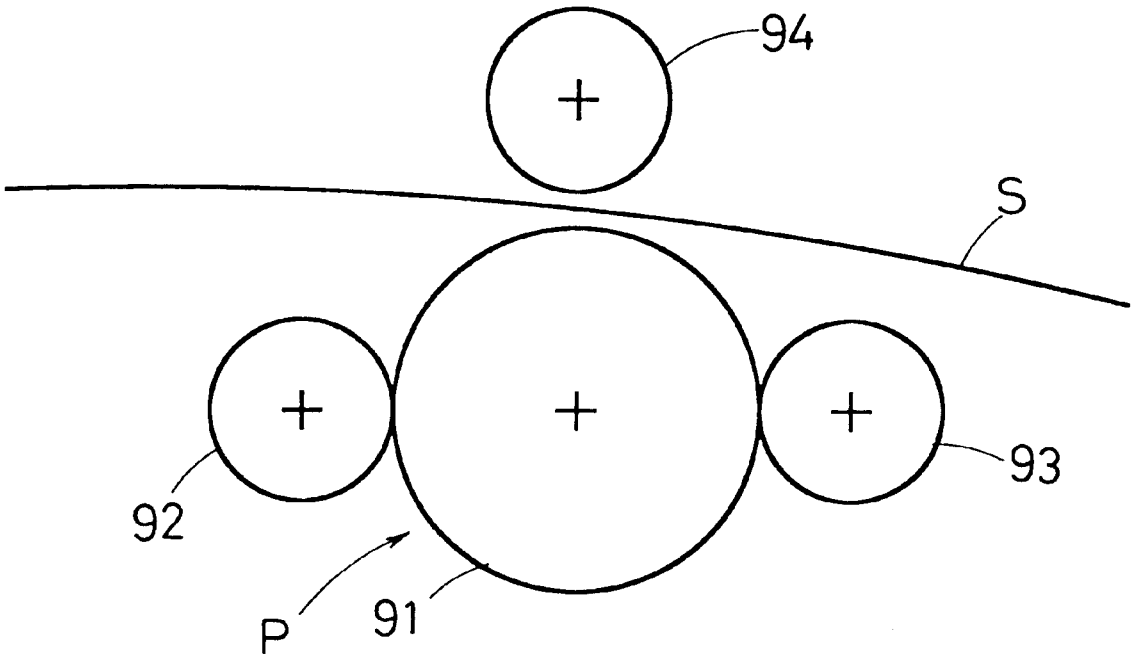
FIG. 6 PRIOR ART
FIG. 6 is a sectional view of a main portion of a general printing process unit.
Figure 7:
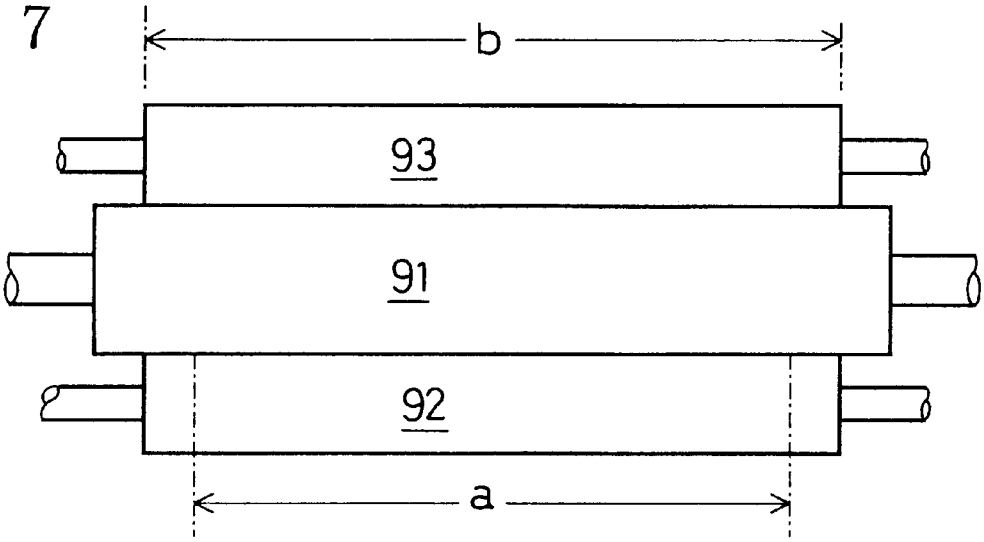
FIG. 7 is a view in which an essential part of a conventional printing process unit is seen from above.
Figure 8:
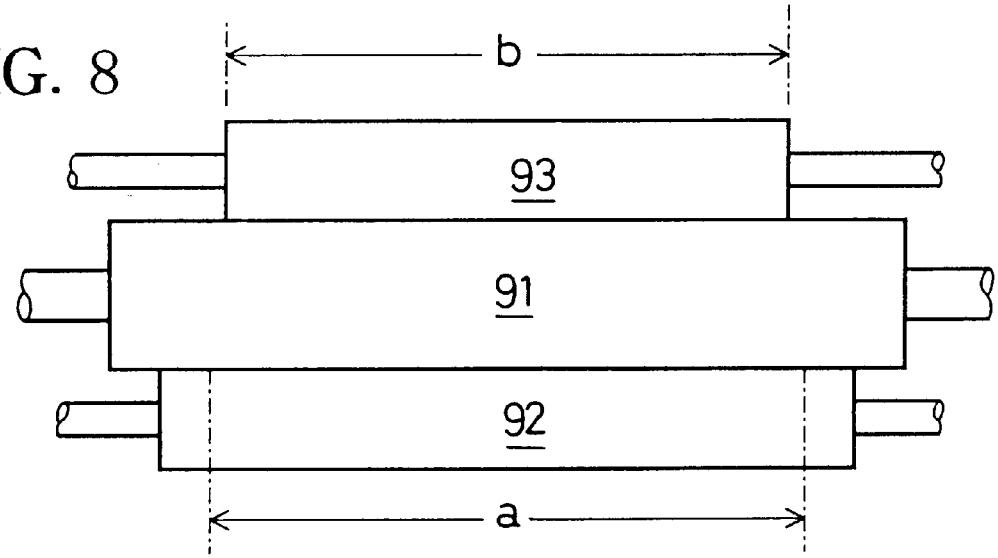
PRIOR ART FIG. 8
FIG. 8 is a view in which an essential part of another conventional printing process unit is seen from above.

This side seal 7 is made of a flexible material such as a sponge. As shown in the side view of FIG. 3, the side seal 7 is supported by the side seal holder 9 to be in close contact with the blade 24 and to be in contact with the area from the position of the developing roller 19 in the vicinity of the blade 24 to approximately the lower edge position 19*a*. The side seal holder 9 is formed as a portion of the case 25 which makes the process unit 3 as a cartridge. A bottom surface 9*a* of the side seal holder 9 along which the side seal 7 is set has an inclined surface for inclining the leading edge 7*a* of the side seal 7. Accordingly, the side seal itself may not be inclined as shown in FIG. 4, while the leading edge 7*a* is inclined along the bottom surface 9*a* when the side seal 7 is attached to the side seal holder 9 as shown in FIG. 5. Although FIGS. 3 to 5 show only one side seal 7, it is needless to say that there are symmetrically two side seals.

Returning to FIG. 2, the width between both side seals 7, 7 is the widest between the positions 19*a*, 19*a* which are the positions immediately before the side seals 7, 7 are in contact with the developing roller 19. This width W1 is wider than a width W2 between the side seals 7, 7 at the supplying roller 20 by about 2 mm. In other words, the width W1 is wider than the width W2 by about 1 mm per one side. The width W3 of the cleaning roller 22 is narrower than the width W1 by about 1 mm and wider than the width W2 by about 1 mm. Accordingly, the following relationship is established among three widths:

$$W2<W3<W1$$

Namely, the difference of 1 mm each exists among three widths. Considering one side, the difference of 0.5 mm each exists among three widths. The reason why the relationship among three widths is established in this order will be explained hereinafter. It is to be noted that the width W2 coincides with the maximum width which is capable of printing to the paper 50.

Subsequently, the operation of the laser printer P is explained.

Firstly, the printing operation is explained. When the paper 50 is printed, the overlaid paper 50 placed on the support plate 10 in the feeding unit 5 of FIG. 1 is separated one by one by the paper separating member 62 to be fed to the resist rollers 13, 14 by the feeding roller 11. The fed paper 50 is transported along the two-dot chain line R. Then, the transported paper 50 is subject to printing in the process unit 3 as described below, while the developing roller 19 maintains a high potential with respect to the photosensitive drum 12 as well as the transferring roller 17 and the cleaning roller 22 maintain a low potential with respect to the photosensitive drum 12.

The photosensitive drum 12 of the process unit 3 rotates such that its peripheral speed coincides with the speed of the transported paper 50. The charged layer is formed on the outer peripheral surface of the photosensitive drum 12 by the charger 18, and then, the electrostatic latent image is formed by the laser beam L from the scanner unit 2.

The developing roller 19 applies toner supplied from the supplying roller 20 to the electrostatic latent image to perform developing operation to form a visual image. At this time, the toner supplied from the supplying roller 20 to the developing roller 19 is regulated by the side seals 7, 7 at both sides to be distributed within the width W2 (FIG. 2) therebetween. The toner layer opposes to the photosensitive drum 12 with its thickness regulated by the blade 24. The toner is absorbed by the low potential of the electrostatic latent image on the photosensitive drum 12 to be adhered thereto, thereby forming a toner image. In this way, the electrostatic latent image is visualized.

When the toner image reaches the position for opposing to the paper 50 and the transferring roller 17 by the rotation of the photosensitive drum 12, the toner image is absorbed by the low potential of the transferring roller 17, whereby the toner image is transferred onto the paper 50.

There may be the case where a small amount of toner remains on the photosensitive drum 12 after the transferring operation. However, when the residual toner reaches the position for opposing to the cleaning roller 22 by the rotation of the photosensitive drum 12, the residual toner is absorbed by the low potential of the cleaning roller 22 to be removed. At this time, the width W3 of the cleaning roller 22 is wider than the width W2 of the developing roller 19, so that the residual toner is entirely removed by the cleaning roller 22. Although it may be possible that the maximum width on which the residual toner on the photosensitive drum 12 can be present is somewhat wider than the supplying width W2 of the developing roller 19, the width W3 is wider than the width W2 by 0.5 mm per one side, whereby the extent of the maximum width compared to the supplying width of the developing roller 19 is covered to entirely perform the removal of the residual toner. Accordingly, it does not occur that the residual toner is not removed by the cleaning roller 22 to stain the paper 50 or the like during the successive printing operation.

The paper 50 on which the toner image is transferred by the transferring roller 17 is subject to the fixing operation by the heat roller 15 and the pressing roller 16 of the fixing unit 4, and then, discharged onto the discharging tray 8 to be stacked thereon.

Subsequently, the non-printing operation is explained. The cleaning roller 22 performs the removal of the residual toner on the photosensitive drum 12 during the printing operation as described above, so that the toner accumulated on the cleaning roller 22 is removed during the non-printing operation. Therefore, the photosensitive drum 12 is caused to be rotated during the non-printing operation in the same manner as during the printing operations Contrary to the case during the printing operation, the cleaning roller 22 is set to have a high potential with respect to the photosensitive drum 12 and the developing roller 19 is set to have a low potential with respect to the photosensitive drum 12.

As a result, the toner accumulated on the cleaning roller 22 is absorbed by the photosensitive drum 12 which has a lower potential, whereby the accumulated toner is removed from the cleaning roller 22. When it reaches the position opposite the developing roller 19 by the rotation of the photosensitive drum 12, the accumulated toner moved to the photosensitive drum 12 is absorbed due to the low potential to be collected by the developing roller 19.

The toner collected by the developing roller 19 is, when it reaches the position where the side seals 7, 7 at both sides are in contact with the developing roller 19, gathered within the width W2 (FIG. 2) due to the inclined shape of the side seals 7, 7. The toner collected by the developing roller 19 can be present within the width W3 of the cleaning roller 22. However, the width W1 is wider than the width W3 between the positions 19*a*, 19*a* which are the positions immediately before the side seals 7, 7 come into contact with the developing roller 19, so that the toner collected by the developing roller 19 is entirely gathered within the width W2. It may be possible that the distribution width of toner is somewhat wider than the width W3 during the process for removing toner from the cleaning roller 22 to be collected by the developing roller 19. However, the width W1 is wider than the width W3 by 0.5 mm per one side, so that the toner is not distributed beyond the width W1, whereby the toner is entirely collected by the developing roller 19.

Accordingly, the toner accumulated on the cleaning roller 22 is finally gathered within the width W2 on the developing roller 19. The width W2 coincides with the maximum printable width, resulting in that the toner is not present beyond this width during the successive printing operation to prevent the paper 50 from being stained while the collected toner can be reused.

As described above in detail, in the laser printer P according to the embodiment, the maximum width from which the toner can be supplied from the supplying roller 20 to the developing roller 19, i.e., the maximum width which is capable of printing to the paper 50 is set to the width W2 which is between the side seals 7, 7 at the supplying roller 20, and further, the width W3 of the cleaning roller 22 is wider than the width W2, whereby the residual toner on the photosensitive drum 12 after the transferring to the paper 50 can entirely be collected by the cleaning roller 22 to be capable of preparing for the next printing operation with the outer peripheral surface of the photosensitive drum 12 cleaned.

Further, the leading edges 7*a*, 7*a* of the side seals 7, 7 are inclined to have a space therebetween which becomes gradually wide toward the front side, and the width W1 at the position 19*a* which is immediately before the side seal comes into contact with the developing roller 19 is larger than the width W3, so that the toner removed from the cleaning roller 22 to be collected by the developing roller 19 at the non-printing operation can be gathered within the width W2 by the side seals 7, 7. As a result, the printing operation is not performed with the toner distributed beyond the maximum printable width. Therefore, the excellent laser printer P in which the paper 50 or the like is not stained by unnecessary toner is provided.

Further, the laser printer P has the widths W2, W3, W1, the space between W2 and W3 as well as the space between W3 and W1 being set as 1 mm (0.5 mm per one side), thereby assuredly executing the removal of the residual toner at the cleaning roller 22 and the gathering of the collected toner by the side seals 7, 7. Moreover, it is unnecessary to excessively enlarge the entire width of each roller, thereby rendering the whole construction compact. The inner surfaces of the side seals 7, 7 are inclined, whereby the toner removed from the cleaning roller 22 to be collected by the developing roller 19 at the non-printing operation can be gathered by the inclined inner surfaces of the side seals 7, 7 to be accommodated within the range of the width W2.

The side seals 7, 7 are made of a flexible material such as a sponge and inserted to the side seal holder 9 having the inclined bottom surface 9*a*, with the result that, if the side seal itself is flat without being inclined, the side seal is brought into an inclined state along the bottom surface 9*a* when inserted, thereby gathering the toner by the inclined inner surface. Accordingly, the side seals 7, 7 are easily formed. Moreover, the side seal holder 9 is formed as a part of the case 25 which makes the process unit 3 as a cartridge, to thereby bring an advantage of reducing the number of parts.

It is to be understood that the present invention is not limited to the above-mentioned embodiment. Many variations thereof are possible without departing from the invention's spirit and scope. For example, the numerical values shown in the embodiment are solely for the purpose of illustration.

As apparent from the above explanation, the invention provides a printing process unit capable of assuredly collecting the residual toner on the photosensitive drum at the printing operation and of preventing the toner from being adhered on the portion of the developing roller other than the developing width at the non-printing operation, thereby preventing the deterioration of the image quality by unnecessary toner.

The invention provides a printing process unit capable of entirely gathering the toner removed from the cleaning roller by the side seal members at the non-printing operation.

The invention provides a printing process unit in which the toner collected by the developing roller is caused to be gathered within the printable width by the side seal members, so that the printing operation is not performed with the toner adhered on the portion beyond the range of the printable width, to thereby prevent the deterioration of the image quality by the toner present at the portion beyond the range of the printable width.

The invention provides a printing process unit in which the toner removed from the cleaning roller to be collected by the developing roller at the non-printing operation is caused to be concentrated by the side seal members within the width of the supplying roller, i.e., the printable width, so that the toner does not remain beyond the width, whereby the printing medium or the like is prevented from being stained by unnecessary toner.

The invention provides a printing process unit capable of assuredly performing the removal of toner by the cleaning roller and the concentration of toner by the side seal members, resulting in that the size of each roller does not become excessively large.

The invention provides a printing process unit in which the toner collected by the developing roller is caused to be concentrated by the inclined shape of the inner surface of the side seal members.

The invention provides a printing process unit in which the side seal members itself may be a flat type which surely has the inclined surface when inserted into the holder.

What is claimed is:

1. A printing process unit utilized for a printer, comprising:

a photosensitive drum that transfers toner to a print medium;

a developing roller that supplies and collects toner at a position before a transferring operation by the photosensitive drum to the print medium;

a cleaning roller that collects and removes toner at a position after the transferring operation by the photosensitive drum to the print medium, the cleaning roller having a first width which is larger than a second width over which the photosensitive drum is capable of printing on the print medium;

a toner supply roller in contact with the developing roller, the toner supply roller having first and second sides and a width between the first and second sides that is substantially the same as the second width; and a pair of side seal members that gather, in excess of the first width of cleaning roller, toner removed to the photosensitive drum from the cleaning roller and collected on the developing roller within a width that is substantially the same as the second width, the side seal members having respective base portions that are positioned substantially at the first and second sides, respectively, of the toner supply roller.

2. The printing process unit according to claim 1, wherein the side seal members have leading edge portions contacting the developing roller, the leading edge portions being extended from the base portions so that a third width between the leading edge portions gradually widens.

3. The printing process unit according to claim 2, wherein a maximum width between the side seal members is defined by the third width between the leading edge portions and the third width is set larger than the first width of the cleaning roller.

4. The printing process unit according to claim 3, wherein a difference between the third width and the second width for gathering toner on the developing roller is set in a range of 1 mm–3 mm.

5. The printing process unit according to claim 4, wherein the difference between the third width and the second width for gathering toner on the developing roller is approximately set to 2 mm.

6. The printing process unit according to claim 5, wherein there exists a relation of: the second width for gathering toner<the first width of the cleaning roller<the third width.

7. The printing process unit according to claim 6, wherein a difference between the third width and the first width of cleaning roller is approximately set to 1 mm and a difference between the first width of cleaning roller and the second width for gathering toner is approximately set to 1 mm.

8. The printing process unit according to claim 3, wherein each of the side seal members has an inner surface which is inclined between the leading edge portion and the base portion.

9. The printing process unit according to claim 2, wherein the side seal members are made of flexible material.

10. The printing process unit according to claim 9, further comprising a pair of holder parts formed in a case of the printing process unit for retaining the side seal members.

11. The printing process unit according to claim 10, wherein the holder parts have bottom surfaces on which the side seal members are set, the bottom surfaces being inclined so that the width between the leading edge portions gradually become wider and wider.

12. The printing process unit according to claim 9, wherein the flexible material is sponge material.

13. A printing process unit utilized for a printer, comprising:

a photosensitive drum that transfers toner to a print medium;

a developing roller that supplies and collects toner at a position before a transferring operation by the photosensitive drum to the print medium;

a cleaning roller that collects and removes toner at a position after the transferring operation by the photosensitive drum to the print medium, the cleaning roller having a first width which is larger than a second width over which the photosensitive drum is capable of printing on the print medium;

a toner supply roller in contact with the developing roller, the toner supply roller having first and second sides and a width between the first and second sides that is substantially the same as the second width; and a pair of side seal members that gather toner removed to the photosensitive drum from the cleaning roller and collected on the developing roller, the side seal members cooperatively gathering toner from a range of the developing roller wider than the first width of the cleaning roller toward a range of the developing roller that is substantially the same as the second width, the side seal members having respective base portions that are positioned substantially at the first and second sides, respectively, of the toner supply roller.

* * * * *